US008514156B2

(12) United States Patent
Koyama

(10) Patent No.: US 8,514,156 B2
(45) Date of Patent: Aug. 20, 2013

(54) DYNAMIC ADJUSTMENT OF COUNTER ELECTRODE VOLTAGE OF LIQUID CRYSTAL PANEL ACCORDING TO ILLUMINATION LIGHT CONTROL

(75) Inventor: Fumio Koyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1740 days.

(21) Appl. No.: 11/698,931

(22) Filed: Jan. 29, 2007

(65) Prior Publication Data

US 2007/0211015 A1 Sep. 13, 2007

(30) Foreign Application Priority Data

Mar. 7, 2006 (JP) ..... 2006-061377

(51) Int. Cl.
*G09G 3/36* (2006.01)

(52) U.S. Cl.
USPC ..... 345/87; 345/30; 345/55; 345/82

(58) Field of Classification Search
None
See application file for complete search history.

(56) References Cited

U.S. PATENT DOCUMENTS

| | | | |
|---|---|---|---|
| 6,683,657 | B1 | 1/2004 | Miyawaki |
| 7,109,984 | B2 | 9/2006 | Moon |
| 7,737,963 | B2 | 6/2010 | Moon |
| 2005/0190172 | A1 | 9/2005 | Koyama |
| 2006/0274006 | A1 | 12/2006 | Moon |

FOREIGN PATENT DOCUMENTS

| | | | |
|---|---|---|---|
| CN | 1414539 | A | 4/2003 |
| CN | 1652014 | A | 8/2005 |
| JP | A-6-250148 | | 9/1994 |
| JP | A-9-106267 | | 4/1997 |
| JP | A-2001-100699 | | 4/2001 |
| JP | A-2003-162002 | | 6/2003 |
| JP | A-2003-186455 | | 7/2003 |
| JP | A 2004-45634 | | 2/2004 |
| JP | A 2004-133177 | | 4/2004 |
| JP | A 2005-164704 | | 6/2005 |
| JP | A 2005-221569 | | 8/2005 |
| JP | A 2006-3607 | | 1/2006 |

*Primary Examiner* — Sumati Lefkowitz
*Assistant Examiner* — Jesus Hernandez
(74) *Attorney, Agent, or Firm* — Oliff & Berridge, PLC

(57) ABSTRACT

The image display apparatus of the invention has: a liquid crystal panel that is used to display an image represented by input image data; and a lighting device that emits illumination light controlled according to a light control level suitable for the input image data and irradiates the liquid crystal panel with the controlled illumination light. The image display apparatus further includes a counter electrode voltage control module that generates a counter electrode voltage to be input into the liquid crystal panel and supplies the generated counter electrode voltage to the liquid crystal panel. The counter electrode voltage control module has: a counter electrode voltage setting module that sets a counter electrode voltage control level corresponding to the light control level; and a counter electrode voltage generation module that generates the counter electrode voltage in response to the set counter electrode voltage control level. This arrangement enables dynamic adjustment of the counter electrode voltage of the liquid crystal panel in response to a dynamic change in amount of the illumination light for irradiating the liquid crystal panel.

5 Claims, 3 Drawing Sheets

DYNAMIC ADJUSTMENT OF COUNTER ELECTRODE VOLTAGE OF LIQUID CRYSTAL PANEL ACCORDING TO ILLUMINATION LIGHT CONTROL

BACKGROUND OF THE INVENTION

1. Field of the Invention

The present invention relates to a technique of dynamically adjusting the counter electrode voltage of a liquid crystal panel used for an image display apparatus according to illumination light control.

2. Description of the Related Art

One proposed technique applicable to a projector or another image display apparatus controls the light level of a lighting device to be suitable for input image data, so as to regulate the luminance of a resulting displayed image and improve the picture quality of the displayed image (see, for example, Japanese Patent Laid-Open Gazette No. 2004-45634).

Liquid crystal panels are widely used in the image display apparatus as the electro-optic device for displaying an image represented by input image data. The liquid crystal panel changes a voltage applied to each pixel electrode specific for each pixel (pixel electrode voltage) relative to a voltage applied to a counter electrode common to respective pixels (counter electrode voltage), based on image data of each pixel. The transmittance of illumination light for irradiating each pixel is regulated in response to the variation in pixel electrode voltage. The liquid crystal panel outputs image light with the regulated light transmittance, which is focused on a screen or another equivalent device to display an image.

The optimum level of the reference counter electrode voltage is varied with a change in amount of illumination light for irradiating the liquid crystal panel. As is known in the art, a significant deviation of the counter electrode voltage from the optimum level causes a trouble, such as flicker or burn-in, to deteriorate the image quality. One conventionally known technique adopted in the image display apparatus with the liquid crystal panel sets the counter electrode voltage to the optimum level before shipment and adjusts the counter electrode voltage to the varying optimum level with a time change of illumination light (see, for example, Japanese Patent Laid-Open Gazette No. 2005-221569).

The light control of the lighting device according to the input image data, however, has a problem of varying the optimum level of the counter electrode voltage with a dynamic change in amount of illumination light for irradiating the liquid crystal panel.

SUMMARY OF THE INVENTION

The object of the invention is thus to eliminate the drawbacks of the prior art and to provide a technique of preventing potential deterioration of the image quality caused by a dynamic change in amount of illumination light for irradiating a liquid crystal panel.

In order to attain at least part of the above and the other related objects, the present invention is directed to a first image display apparatus having: a liquid crystal panel that is used to display an image represented by input image data; and a lighting device that emits illumination light controlled according to a light control level suitable for the input image data and irradiates the liquid crystal panel with the controlled illumination light.

The first image display apparatus of the invention further includes a counter electrode voltage control module that generates a counter electrode voltage to be input into the liquid crystal panel and supplies the generated counter electrode voltage to the liquid crystal panel. The counter electrode voltage control module has: a counter electrode voltage setting module that sets a counter electrode voltage control level corresponding to the light control level; and a counter electrode voltage generation module that generates the counter electrode voltage in response to the set counter electrode voltage control level.

The first image display apparatus of the invention sets the counter electrode voltage of the liquid crystal panel according to the light control level of the lighting device. Such setting enables dynamic adjustment of the counter electrode voltage of the liquid crystal panel in response to a dynamic change in amount of the illumination light for irradiating the liquid crystal panel. This arrangement effectively prevents potential deterioration of the image quality caused by a dynamic change in amount of the illumination light for irradiating the liquid crystal panel.

In one preferable embodiment of the first image display apparatus of the invention, the counter electrode voltage setting module has a map of the counter electrode voltage control level in correlation to the light control level and refers to the map to set the counter electrode voltage control level corresponding to the light control level.

This arrangement facilitates setting of the counter electrode voltage control level corresponding to the light control level.

The present invention is also directed to a second image display apparatus having: a liquid crystal panel that is used to display an image represented by input image data; and a lighting device that emits illumination light controlled according to a light control level suitable for the input image data and irradiates the liquid crystal panel with the controlled illumination light.

The second image display apparatus of the invention further includes: a counter electrode voltage generation module that generates a preset reference counter electrode voltage input into the liquid crystal panel; and an image data correction module that, in the event of a deviation of an optimum counter electrode voltage to be input into the liquid crystal panel from the preset reference counter electrode voltage with a light control level-induced change in illumination light, computes a correction amount of image data from a difference between the optimum counter electrode voltage and the preset reference counter electrode voltage, based on the light control level, and corrects the input image data with the computed correction amount.

The second image display apparatus of the invention corrects the input image data according to the light control level of the lighting device. Such correction enables substantial dynamic adjustment of the counter electrode voltage of the liquid crystal panel in response to a dynamic change in amount of the illumination light for irradiating the liquid crystal panel. This arrangement effectively prevents potential deterioration of the image quality caused by a dynamic change in amount of the illumination light for irradiating the liquid crystal panel.

In one preferable embodiment of the second image display apparatus of the invention, the image data correction module has a map of the correction amount of image data in correlation to the light control level and refers to the map to specify the correction amount of image data corresponding to the light control level.

This arrangement facilitates computation of the correction amount of image data in response to a variation in counter electrode voltage corresponding to the light control level.

In one preferable application of either of the first image display apparatus and the second image display apparatus, the lighting device includes: a light source that emits light; a light control level setting module that sets the light control level suitable for the input image data; and a light controller that regulates an amount of transmission of the light emitted from the light source corresponding to the set light control level to control an amount of the illumination light for irradiating the liquid crystal panel.

In another preferable application of either of the first image display apparatus and the second image display apparatus, the lighting device includes: a light source that emits light; a light control level setting module that sets the light control level suitable for the input image data; and a light emission amount regulator that regulates an emission amount of the light emitted from the light source corresponding to the set light control level.

DESCRIPTION OF THE PREFERRED EMBODIMENTS

Some modes of carrying out the invention are described below in the following sequence as preferred embodiments with reference to the accompanied drawings:

A. First Embodiment
B. Second Embodiment
C. Third Embodiment
D. Modifications

A. First Embodiment

Figure 1:
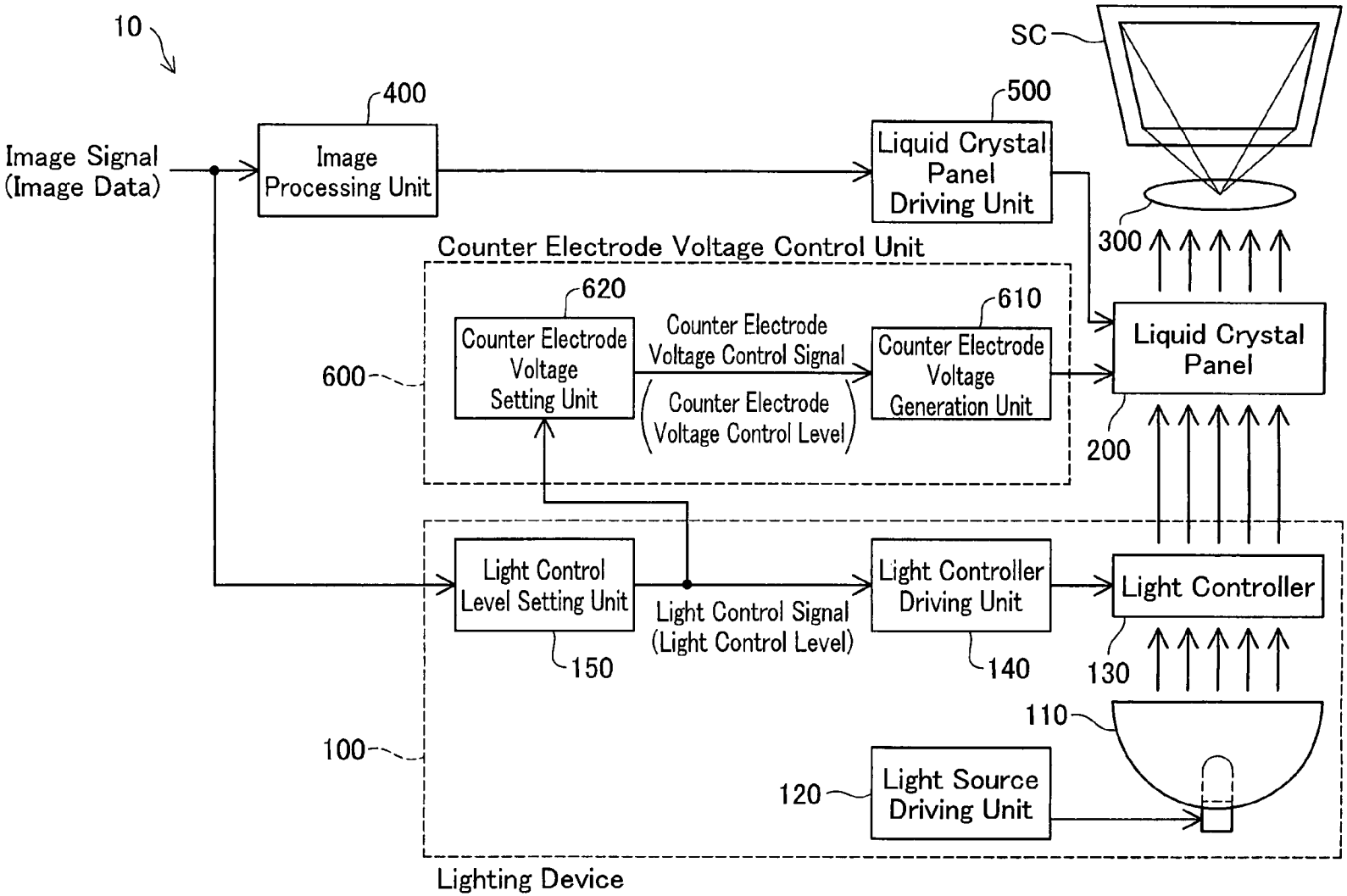
FIG. 1 is a block diagram schematically illustrating the configuration of main part of a liquid crystal projector in a first embodiment of the invention.

FIG. 1 is a block diagram schematically illustrating the configuration of main part of a liquid crystal projector 10 in a first embodiment of the invention. The liquid crystal projector 10 includes a lighting device 100, a liquid crystal panel 200, a projection optical system 300, an image processing unit 400, a liquid crystal panel driving unit 500, and a counter electrode voltage control unit 600.

The lighting device 100 includes a light source 110, a light source actuator 120, a light controller 130, a light controller driving unit 140, and a light control level setting unit 150.

The light source 110 emits light in response to a driving signal supplied from the light source actuator 120.

The light controller 130 regulates the amount of transmission of the light emitted from the light source 110 in response to a driving signal supplied from the light controller driving unit 140 to control the amount of illumination light for irradiating the liquid crystal panel 200. The light controller 130 may be any of diverse light valves, for example, a liquid crystal panel or a shutter with variable opening.

The light controller driving unit 140 generates the driving signal for driving the light controller 130 corresponding to a light control level represented by a light control signal supplied from the light control level setting unit 150.

The light control level setting unit 150 sets the light control level to be suitable for image data included in an input image signal and outputs the set light control level as the light control signal. Setting the light control level to be suitable for image data is implemented by the conventional light control technique and is not specifically described here.

The image processing unit 400 performs diverse series of image processing on image data and outputs processed image data as an image signal suppliable to the liquid crystal panel driving unit 500. The available series of image processing include adjustment of various image quality-affecting characteristics, such as luminance adjustment, color balance adjustment, contrast adjustment, and sharpness adjustment, image size expansion and contraction, and correction for elevated projection.

The liquid crystal panel driving unit 500 generates a driving signal, which corresponds to a pixel electrode voltage to be applied to each pixel electrode (hereafter referred to as 'pixel electrode driving signal'), according to the processed image data input from the image processing unit 400 to drive the liquid crystal panel 200. The generated pixel electrode driving signal is given to a pixel electrode driving signal input terminal of the liquid crystal panel 200.

The counter electrode voltage control unit 600 includes a counter electrode voltage generation unit 610 and a counter electrode voltage setting unit 620.

The counter electrode voltage generation unit 610 generates a driving signal, which corresponds to a counter electrode voltage as the base for actuating the liquid crystal panel 200 (hereafter referred to as 'counter electrode driving signal'), according to a counter electrode voltage control level represented by a counter electrode voltage control signal supplied from the counter electrode voltage setting unit 620. The generated counter electrode driving signal is given to a counter electrode driving signal input terminal of the liquid crystal panel 200.

The counter electrode voltage setting unit 620 sets a counter electrode voltage control level corresponding to the light control level represented by the light control signal supplied from the light control level setting unit 150 and outputs the set counter electrode voltage control level as a counter electrode voltage control signal. The counter electrode voltage setting unit 620 stores therein a map of the counter electrode voltage control level in correlation to the light control level. The counter electrode voltage setting unit 620 refers to the stored map to specify the counter electrode voltage control level corresponding to the light control level represented by the light control signal supplied from the light control level setting unit 150.

The liquid crystal panel 200 modulates the illumination light emitted from the lighting device 100, in response to the pixel electrode driving signal output from the liquid crystal panel driving unit 500 and the counter electrode driving signal output from the counter electrode voltage generation unit 610. The modulated light is output as transmitted light to the projection optical system 300.

The projection optical system 300 focuses the modulated light output from the liquid crystal panel 200 on a screen SC to display a projected image.

As described above, the liquid crystal projector 10 of the first embodiment controls the illumination light for irradiating the liquid crystal panel 200 according to the light control level, which is set to be suitable for the image data included in each input image signal. The concrete procedure of the first embodiment specifies the counter electrode voltage control level corresponding to the light control level and generates the counter electrode voltage in response to the specified counter electrode voltage control level. Such specification and generation enable dynamic adjustment of the counter electrode voltage of the liquid crystal panel 200 in response to a dynamic change in amount of illumination light for irradiating the liquid crystal panel 200. This arrangement thus effectively prevents potential deterioration of the image quality caused by the dynamic change in amount of illumination light for irradiating the liquid crystal panel 200.

B. Second Embodiment

Figure 2:
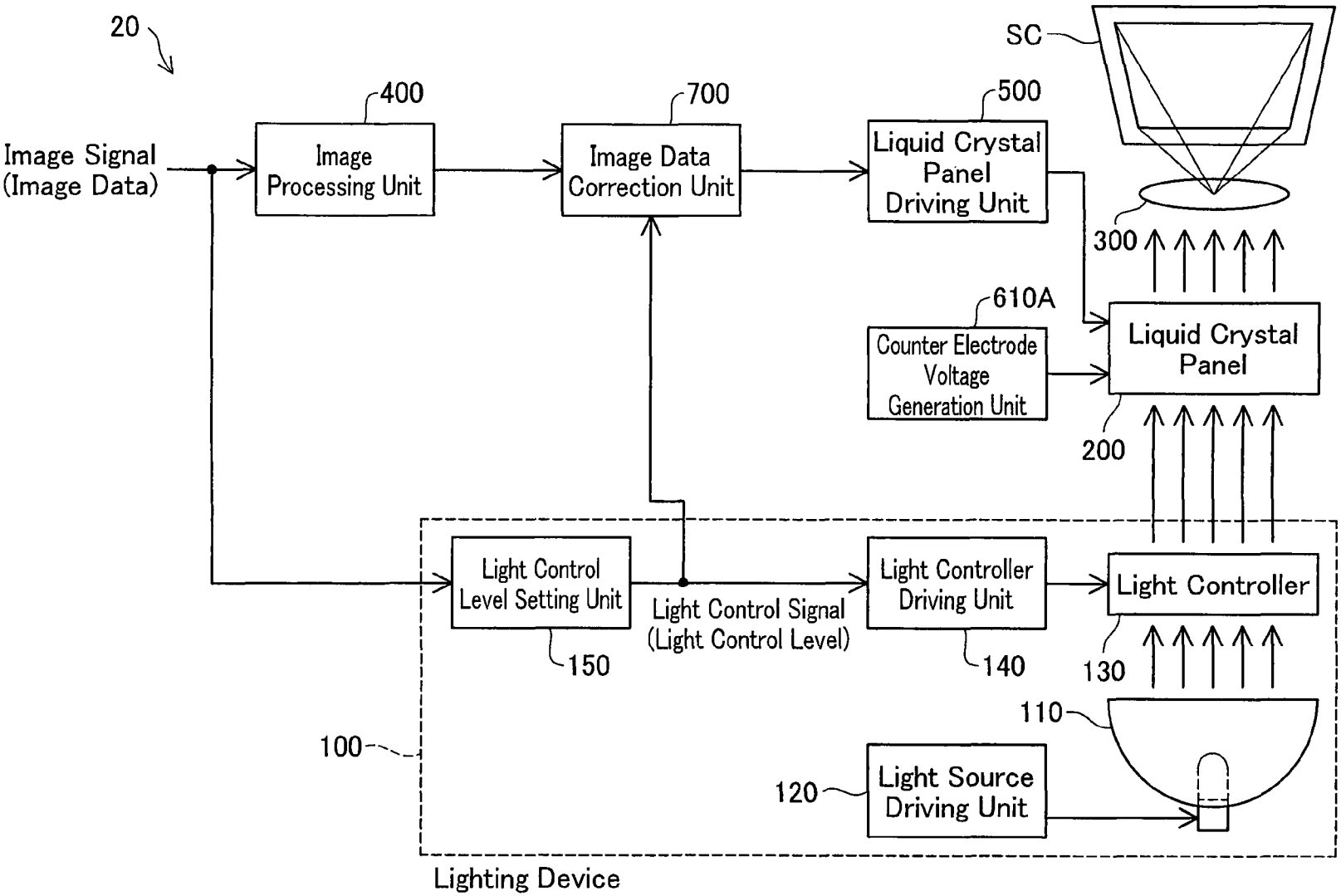
FIG. 2 is a block diagram schematically illustrating the configuration of main part of a liquid crystal projector in a second embodiment of the invention.

FIG. 2 is a block diagram schematically illustrating the configuration of main part of a liquid crystal projector 20 in a second embodiment of the invention. The liquid crystal projector 20 of the second embodiment has the similar configuration to that of the liquid crystal projector 10 of the first embodiment shown in FIG. 1, except that the counter electrode voltage control unit 600 is replaced by a counter electrode voltage generation unit 610A and that an image data correction unit 700 is additionally provided between the image processing unit 400 and the liquid crystal panel driving unit 500.

The counter electrode voltage generation unit 610A of the embodiment generates a counter electrode driving signal representing a preset reference counter electrode voltage.

The optimum level of the counter electrode voltage to be input into the liquid crystal panel 200 is varied with a change in illumination light based on the light control level. The procedure of the first embodiment directly corrects the counter electrode voltage input into the liquid crystal panel 200, based on the light control level. The procedure of the second embodiment, on the other hand, does not directly correct the counter electrode voltage but corrects input image data with a computed correction amount. In the configuration of the second embodiment, the preset reference counter electrode voltage is input in the liquid crystal panel 200. The image data correction unit 700 computes, based on the light control level, a required correction amount of image data from a difference between the optimum counter electrode voltage to be input into the liquid crystal panel 200 and the preset reference counter electrode voltage, and corrects input image data with the computed correction amount.

The image data correction unit 700 stores therein a map of the correction amount of image data in correlation to the light control level represented by the light control signal supplied from the light control level setting unit 150. The image data correction unit 700 refers to the stored map and specifies the correction amount of image data corresponding to the light control level represented by the light control signal supplied from the light control level setting unit 150.

As described above, the liquid crystal projector 20 of the second embodiment computes, based on the light control level, the required correction amount of image data from the difference between the optimum counter electrode voltage to be input into the liquid crystal panel 200 and the preset reference counter electrode voltage, and corrects input image data with the computed correction amount. Such computation and correction enable substantial dynamic adjustment of the counter electrode voltage of the liquid crystal panel 200 in response to a dynamic change in amount of illumination light for irradiating the liquid crystal panel 200. This arrangement thus effectively prevents potential deterioration of the image quality caused by the dynamic change in amount of illumination light for irradiating the liquid crystal panel 200.

C. Third Embodiment

Figure 3:
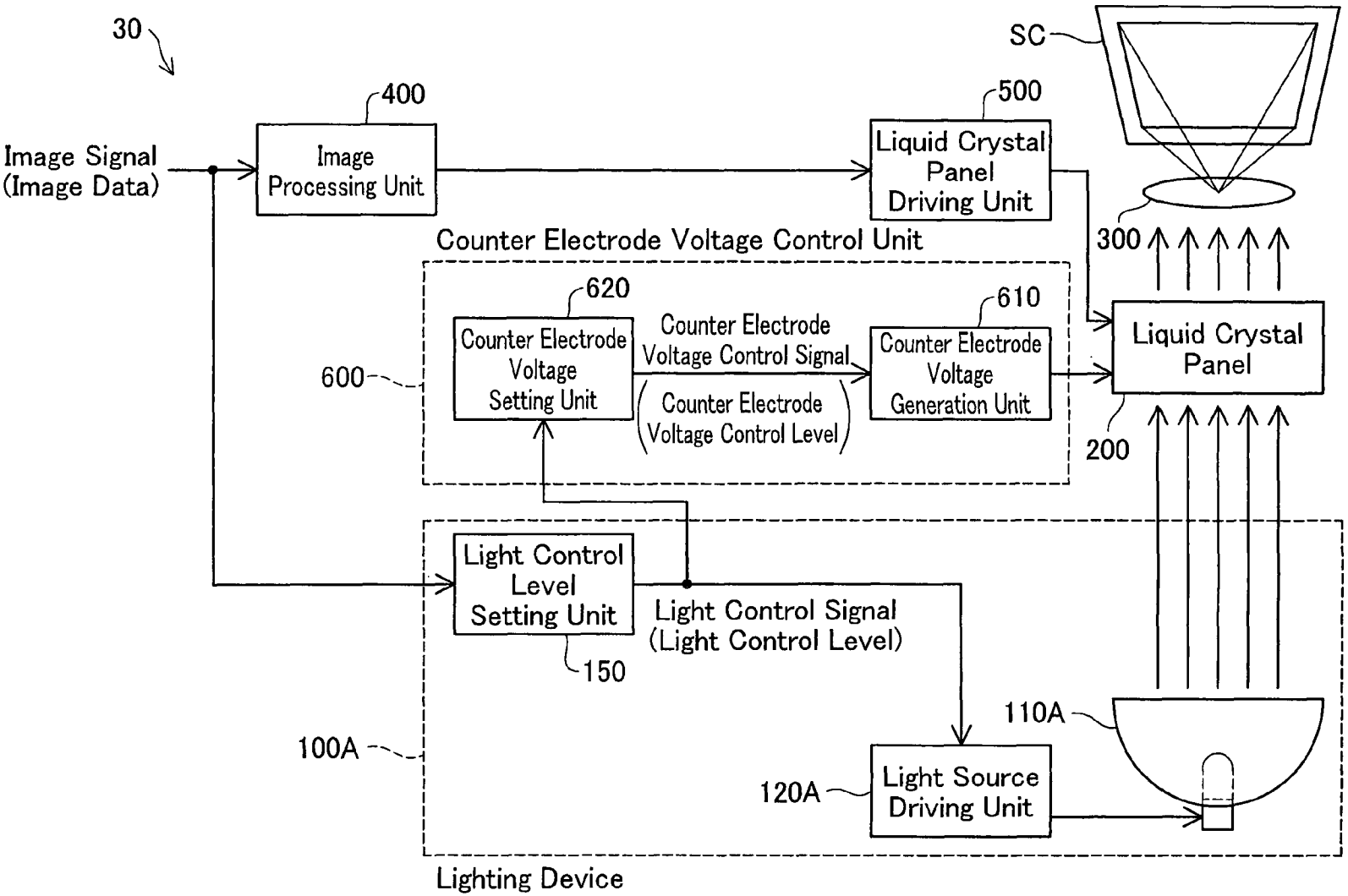
FIG. 3 is a block diagram schematically illustrating the configuration of main part of a liquid crystal projector in a third embodiment of the invention.

FIG. 3 is a block diagram schematically illustrating the configuration of main part of a liquid crystal projector 30 in a third embodiment of the invention. The liquid crystal projector 30 of the third embodiment has the similar configuration to that of the liquid crystal projector 10 of the first embodiment shown in FIG. 1, except that a light source 110A of a lighting device 100A has the function of a light controller and that a light source driving unit 120A for driving the light source 110A also functions as a light controller driving unit.

The light source driving unit 120A controls the driving signal for actuating the light source 110A according to the light control level represented by the light control signal supplied from the light control level setting unit 150, so as to regulate the amount of light emission from the light source 110A.

Available examples for the light source 110A include a light emitting diode, in addition to a halogen lamp and a high-pressure mercury discharge lamp conventionally used for the light source 110 of the first embodiment. The light emitting diode has the higher light control speed and is thus advantageous for the light source 110A.

As described above, the liquid crystal projector 30 of the third embodiment controls the illumination light for irradiating the liquid crystal panel 200 according to the light control level, which is set to be suitable for the image data included in each input image signal. The concrete procedure of the third embodiment specifies the counter electrode voltage control level corresponding to the light control level and generates the counter electrode voltage in response to the specified counter electrode voltage control level. Such specification and generation enable dynamic adjustment of the counter electrode voltage of the liquid crystal panel 200 in response to a dynamic change in amount of illumination light for irradiating the liquid crystal panel 200. This arrangement thus effectively prevents potential deterioration of the image quality caused by the dynamic change in amount of illumination light for irradiating the liquid crystal panel 200. The arrangement of the third embodiment is described as a modification of the first embodiment but is also applicable to the configuration of the second embodiment.

D. Modifications

The embodiments discussed above are to be considered in all aspects as illustrative and not restrictive. There may be many modifications, changes, and alterations without departing from the scope or spirit of the main characteristics of the present invention.

(1) MODIFIED EXAMPLE 1

In the configuration of the first embodiment, the counter electrode voltage setting unit 620 refers to the map of the counter electrode voltage control level in correlation to the light control level and specifies the counter electrode voltage control level corresponding to the light control level represented by the light control signal supplied from the light control level setting unit 150. This method is, however, not essential. Any other suitable method is adopted to determine the counter electrode voltage control level corresponding to the light control level. One applicable method may calculate the counter electrode voltage control level according to a function expression representing the characteristic of the counter electrode voltage control level related to the light control level.

In the configuration of the second embodiment, the image data correction unit 700 refers to the map of the correction amount of image data in correlation to the light control level and specifies the correction amount of image data corresponding to the light control level represented by the light control signal supplied from the light control level setting unit 150. This method is, however, not essential. Any other suitable method is adopted to determine the correction amount of image data corresponding to the light control level. One applicable method may calculate the correction amount of image data according to a function expression representing the characteristic of the correction amount of image data related to the light control level.

(2) MODIFIED EXAMPLE 2

The above embodiments regard the liquid crystal projector with the single liquid crystal panel. The technique of the invention is, however, not restricted to the liquid crystal projector with the single liquid crystal panel but is also applicable to a liquid crystal projector with three liquid crystal panels or another number of multiple liquid crystal panels. In this case, the counter electrode voltage control unit is provided for each of the multiple liquid crystal panels.

(3) MODIFIED EXAMPLE 3

The above embodiments regard the liquid crystal projector with the liquid crystal panel. The technique of the invention is, however, not restricted to the liquid crystal projector but is also applicable to a direct-sight image display apparatus with a liquid crystal panel.

What is claimed is:

1. An image display apparatus having: a liquid crystal panel that is used to display an image represented by input image data; and a lighting device that emits illumination light controlled according to a light control level suitable for the input image data and irradiates the liquid crystal panel with the controlled illumination light, the image display apparatus further comprising:

a counter electrode voltage generation module that generates a preset reference counter electrode voltage input into the liquid crystal panel; and an image data correction module that, in the event of a deviation of an optimum counter electrode voltage to be input into the liquid crystal panel from the preset reference counter electrode voltage with a light control level-induced change in illumination light, computes a correction amount of image data from a difference between the optimum counter electrode voltage and the preset reference counter electrode voltage, based on the light control level, and corrects the input image data with the computed correction amount to prevent deterioration of image quality due to the change in illumination light, without controlling the counter electrode voltage, wherein the counter electrode voltage is not adjusted to prevent the deterioration of image quality due to the change in illumination light.

2. The image display apparatus in accordance with claim 1, wherein the image data correction module has a map of the correction amount of image data in correlation to the light control level and refers to the map to specify the correction amount of image data corresponding to the light control level.

3. The image display apparatus in accordance with claim 1, wherein the lighting device comprising:

a light source that emits light;

a light control level setting module that sets the light control level suitable for the input image data; and a light controller that regulates an amount of transmission of the light emitted from the light source corresponding to the set light control level to control an amount of the illumination light for irradiating the liquid crystal panel.

4. The image display apparatus in accordance with claim 1, wherein the lighting device comprising:

a light source that emits light;

a light control level setting module that sets the light control level suitable for the input image data; and a light emission amount regulator that regulates an emission amount of the light emitted from the light source corresponding to the set light control level.

5. The image display apparatus in accordance with claim 4, wherein the light control level setting module transmits the light control level to the image data correction module.

* * * * *